United States Patent [19]

Schweimanns

[11] 3,994,701

[45] Nov. 30, 1976

[54] METHOD AND APPARATUS FOR FEEDING COMMINUTED SOLID FUEL INTO PLENUM CHAMBERS

[75] Inventor: Hans-Reiner Schweimanns, Niederwenigern, Germany

[73] Assignee: Shell Internationale Research Maatschappij B.V., The Hague, Netherlands

[22] Filed: July 9, 1975

[21] Appl. No.: 594,263

[30] Foreign Application Priority Data

July 18, 1974 Germany ..... 2434526

[52] U.S. Cl. ..... 48/86 R; 48/197 R; 48/210; 110/105; 302/53; 302/59

[51] Int. Cl.[2] ..... C10J 3/50

[58] Field of Search ..... 48/197 R, 210, DIG. 4, 48/DIG. 7, 86 R; 302/53, 57, 59; 53/22 R, 112 R; 110/104, 105

[56] References Cited

UNITED STATES PATENTS

| | | | |
|---|---|---|---|
| 3,001,652 | 9/1961 | Schroeder et al. | 302/53 |
| 3,775,071 | 11/1973 | Hoffert et al. | 48/197 R |
| 3,809,438 | 5/1974 | Hubbard | 302/59 |

OTHER PUBLICATIONS

Barker et al., "Pressure Feeder for Powdered Coal or Other Finely Divided Solids" Industrial and Engineering Chemistry, vol. 43, No. 5, May 1961.

*Primary Examiner*—Robert L. Lindsay, Jr.
*Assistant Examiner*—George C. Yeung
*Attorney, Agent, or Firm*—Michael J. Striker

[57] ABSTRACT

Charges of finely comminuted solid fuel particles are admitted into an oxygen-containing gasification chamber through a system of locks having an uppermost bunker which is maintained at atmospheric pressure, an intermediate bunker wherein the pressure alternately rises and drops, a lowermost bunker wherein the pressure is always above atmospheric, a metering device which connects the lowermost bunker with the gasification chamber, a pipe which can supply compressed inert gas into the intermediate bunker after the latter has received a charge of fuel particles from the uppermost bunker but before the intermediate bunker is respectively sealed from the uppermost bunker and connected with the lowermost bunker, and a pipe which evacuates compressed gas from the intermediate bunker subsequent to transfer of a charge into the lowermost bunker. The thus evacuated compressed gas is fed to a pneumatic conveyor which supplies charges of fuel particles from a main source to the uppermost bunker while the latter is sealed from the intermediate bunker. The gas evacuating pipe can contain a storage tank for compressed gas so that the admission of fuel particles into the uppermost bunker can be timed independently of the gas pressure in the intermediate bunker.

16 Claims, 1 Drawing Figure

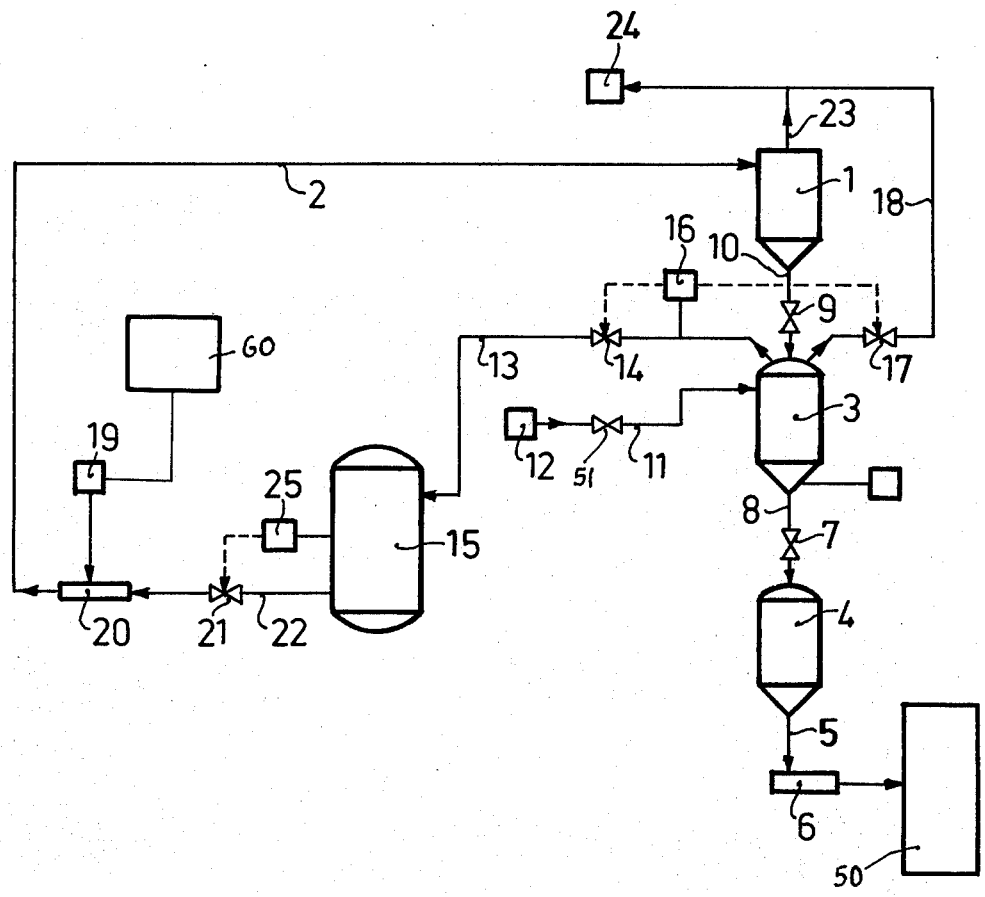
24
23
1
2
18
16
10
9
60
13
14
17
3
19
12
51
11
25
15
8
7
20
21
22
4
5
6
50

METHOD AND APPARATUS FOR FEEDING COMMINUTED SOLID FUEL INTO PLENUM CHAMBERS

BACKGROUND OF THE INVENTION

The present invention relates to a method and apparatus for feeding solid particulate material into a plenum chamber. More particularly the invention relates to improvements in methods and apparatus which can be utilized with advantage to feed charges of finely comminuted solid fuel particles (e.g., coal) to a gasification chamber which contains oxygen and wherein the particles are oxidized, either entirely or in part. Such methods and apparatus can be resorted to in the production of gaseous fuels which are used in households and/or for other purposes.

It is known to feed solid fuel particles into a highly pressurized gasification chamber by resorting to a system of locks wherein a receptacle or bunker must be filled with compressed inert gas prior to transfer of a charge of fuel particles into the chamber, and decompressed prior to admission of a fresh charge by gravity flow. The pressure of the gas (e.g., nitrogen) which is evacuated from the receptacles of such conventional systems is reduced to atmospheric prior to renewed compression for readmission into the receptacle. This contributes to extremely high energy requirements of the system. Moreover, the gas which is being permitted to expand during and subsequent to evacuation from the receptacle performs no useful work.

SUMMARY OF THE INVENTION

An object of the invention is to provide a novel and improved method of feeding flowable solid particulate material into a plenum chamber in such a way that the compressed gas which is used for admission of successive charges from a receptacle in a system of locks into the plenum chamber can perform useful work prior to renewed compression preparatory to reintroduction into the receptacle.

Another object of the invention is to provide a novel and improved method of feeding charges of finely comminuted solid fuel particles into a receptacle which, in turn, admits such charges into a gasification chamber.

A further object of the invention is to provide a novel and improved apparatus which can be utilized for the practice of the above outlined method and whose energy requirements are a small fraction of those of apparatus which are presently utilized for admission of solid fuel particles into a gasification chamber.

An additional object of the invention is to provide the apparatus with novel and improved means for supplying charges of solid fuel particles from a main source into the foremost or uppermost bunker of a system of locks which are interposed between the main source and the gasification chamber.

Still another object of the invention is to reduce the quantities of compressed inert gas which are needed to operate the above outlined apparatus.

A further object of the invention is to provide a novel system of locks including a plurality of serially arranged bunkers and forming part of the improved apparatus.

One feature of the invention resides in the provision of a method of feeding solid particles from a receptacle (e.g., a bunker) into a plenum chamber, particularly of feeding finely comminuted particles of coal or another solid fuel into an oxygen-containing gasification chamber. The method comprises the steps of introducing into the receptacle a charge of solid particles (e.g., from a second bunker or magazine which is located at a level above the receptacle) while the outlet of the receptacle is sealed from the plenum chamber (the connection between the receptacle and the plenum chamber may include a system of conduits which contain a shutoff valve, a third bunker or vessel, and a suitable metering device for solid particles), admitting into the receptacle a compressed gas (preferably nitrogen or another inert gas) to raise the pressure in the receptacle to a pressure exceeding that in the plenum chamber, connecting the receptacle with the plenum chamber (e.g., by opening the aforementioned shutoff valve) whereby the compressed gas undergoes partial expansion and expels at least some solid particles from the receptacle into the plenum chamber, disconnecting or sealing the outlet of the receptacle from the plenum chamber (e.g., by closing the aforementioned valve), evacuating at least some compressed gas from the receptacle so that the pressure in the receptacle drops to or approximates atmospheric pressure, and utilizing the thus evacuated compressed gas for introduction of a fresh charge of solid particles into the receptacle. Such introduction can take place directly or indirectly; in the latter case, preferably by way of a magazine which can store a fresh charge while solid particles are being expelled from the receptacle and which, being preferably located at a level above the receptacle, can discharge the fresh charge by gravity flow as soon as the pressure of gas in the receptacle is reduced to that which prevails in the magazine and as soon as the magazine is thereupon connected with the receptacle, e.g., by opening a second shutoff valve in a conduit which connects the bottom portion of the magazine with an inlet at the top of the receptacle.

The evacuated gas can be stored in a tank prior to its utilization for introduction of a fresh charge of solid particles. Such utilization can involve admitting evacuated compressed gas into a pneumatic conveyor which receives solid particles from a main source (preferably by way of a suitable metering device) whereby the gas constitutes a carrier for solid particles which are being admitted into the magazine so that the latter can accumulate a fresh charge.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a diagrammatic view of an apparatus which embodies one form of the invention and wherein the conduit which supplies finely comminuted solid particles to the magazine is connected with the receptacle by way of storage tank for inert gas.

DESCRIPTION OF THE PREFERRED EMBODIMENTS

The drawing shows an apparatus having a first bunker or magazine 1 which serves for storage of comminuted solid fuel and whose interior is maintained at or close to normal atmospheric pressure. The upper portion of the magazine 1 is connected to the discharge end of a supply conduit 2 which feeds solid fuel particles while such particles are suspended in a gaseous carrier, preferably nitrogen or another inert gas.

A second bunker or receptacle 3 is disposed at a level below the magazine 1 and serves for temporary storage of solid fuel which is to be transported from the magazine 1 into a plenum chamber 50, e.g., a gasification chamber wherein the particles of solid fuel are subjected to partial or complete oxidation and which contains compressed oxygen or a compressed oxygen-containing gaseous fluid. The pressure in the receptacle 3 alternately rises and decreases.

A third bunker or vessel 4 is mounted at a level below the receptacle 3; the interior of the vessel 4 is always maintained at an elevated pressure. The lower end portion of the vessel 4 has an outlet 5 (e.g., an evacuating conduit) which can supply solid fuel particles to a metering device 6; the latter admits metered quantities of solid fuel into the plenum chamber 50.

When the supply of solid fuel in the vessel 4 drops to a predetermined minimum permissible level, a shutoff valve 7 is opened to allow fuel to pass through a conduit 8 which connects the top portion of the vessel 4 with the bottom portion of the receptacle 3. The interior of the receptacle 3 is then maintained at an elevated pressure so that the gas expels fuel into the vessel 4 via conduit 8 and valve 7. A further connecting conduit 10 between the lower end of the magazine 1 and the upper end of the receptacle 3 is then sealed by a shutoff valve 9. The receptacle 3 can be filled or substantially filled with solid fuel when the pressure in its interior decreases to or slightly above atmospheric pressure. The valve 9 is thereupon opened so that the particles of solid fuel can leave the magazine 1 and descend into the receptacle 3 by gravity flow via connecting conduit 10. It is clear that the valve 7 is closed when the valve 9 is open to admit a fresh supply of solid fuel into the receptacle 3.

The means for admitting a compressed inert gas (preferably nitrogen) into the receptacle 3 comprises a supply conduit or pipe 11 which communicates with the upper portion of the receptacle 3 and receives compressed inert gas from a suitable source 12, e.g., a blower, a compressor or an accumulator. The pipe 11 contains a shutoff valve 51. If the pressure of inert gas in the receptacle 3 is to be reduced (prior to admission of fresh solid fuel via connecting conduit 10), a suitable control device 16 opens a shutoff valve 14 which is installed in a return conduit or pipe 13 connecting the upper portion of the receptacle 3 with a storage tank 15 for inert gas. The control device 16 closes the valve 14 when the pressure of inert gas in the receptacle 3 decreases to an intermediate pressure which is higher than atmospheric (i.e., higher than that at which the connecting conduit 10 can admit a charge of solid fuel by gravity flow). At the same time, the control device 16 opens a shutoff valve 17 which is installed in a return conduit or pipe 18 connecting the upper portion of the receptacle 3 with a suitable separator 24 serving to segregate solid fuel particles from inert gas so that the latter can be reused in the apparatus. The valve 17 is closed when the pressure of gas in the receptacle 3 drops to atmospheric pressure or slightly above atmospheric pressure.

The inert gas which accumulates in the storage tank 15 has a pressure which is between atmospheric pressure and the working pressure (the working pressure is that pressure which must be established in the upper portion of the receptacle 3 before the valve 7 opens to admit solid fuel into the vessel 4). In accordance with a feature of the invention, the inert gas which accumulates in the tank 15 is used to supply solid fuel particles to the magazine 1, i.e., to the receptacle 3. The main supply of solid fuel is stored in a container 60 which can receive solid fuel at intervals or continuously, e.g., from a combined fuel comminuting and drying unit (not shown). The container 60 discharges comminuted solid fuel particles into a metering device 19 which, in turn, discharges metered quantities of solid fuel into a pneumatic conveyor 20 having its outlet connected to the supply conduit 2. It is clear that the container 60 can be omitted if the aforementioned comminuting and drying unit is directly coupled to the metering device 19. The inlet of the pneumatic conveyor 20 is connected with a discharge opening in the lower portion of the storage tank 15 by a conduit or pipe 22 containing a shutoff valve 21 which is controlled by a regulating device 25. The device 25 monitors the pressure of inert gas in the storage tank 15. The particles of solid fuel which are admitted into the conveyor 20 by metering device 19 are suspended in the stream of inert gas flowing through the open valve 21 and are caused to advance through the supply conduit 2 and to enter the magazine 1. The solid fuel particles settle in the lower part of the magazine 1 whereas the inert gaseous carrier escapes by way of a discharge conduit or pipe 23 which is connected to the separator 24, either directly or by way of the pipe 18. As mentioned above, the separator 24 segregates solid particles from inert gas which is supplied by pipes 18 and 23, and the thus cleaned inert gas is then compressed and fed to the source 12 for renewed use in the apparatus. The pipe 23 maintains the interior of the magazine 1 at atmospheric pressure.

The regulating device 25 automatically closes the valve 21 when the pressure of inert gas in the tank 15 drops to a preselected minimum value, e.g., to a value at which the gas is incapable of transporting solid fuel particles into the magazine 1. The regulating device 25 can further serve as an automatic relief valve which insures that the pressure of inert gas entering the conveyor 20 via pipe 22 and valve 21 cannot rise beyond a preselected maximum value.

The tank 15 constitutes an advantageous but optional feature of the apparatus, i.e., the pipe 13 can be connected directly with the pipe 22. This tank can be omitted if the apparatus comprises a single plenum chamber 50 and a single set of bunkers 1, 3, 4. However, and as a rule, plants which can utilize the apparatus of the present invention will have a substantial number of plenum chambers for partial or complete oxidation of gaseous fuel. If a plant has two or more plenum chambers 50, the provision of a storage tank 15 is desirable and advantageous because the tank can store sufficient quantities of inert gas to allow for admission of solid fuel particles into any one of several magazines 1 whenever necessary, i.e., not only at such times when the respective return pipe 13 conveys compressed inert gas from the associated receptacle 3. In other words, the provision of a tank 15 insures that the magazine or magazines in a plant with one or more plenum chambers can receive fresh charges of communicated solid fuel whenever necessary and independently of the condition of other components of the apparatus.

An important advantage of the improved apparatus is that the conveyor or conveyors 20 need not be connected to discrete sources of a compressed inert gas, i.e., that inert gas which is used for transfer of solid particles from the receptacle 3 into the plenum chamber 50 can be used to operate the pneumatic conveyor or conveyors. In presently known apparatus, the conveyor or conveyors which deliver solid particles to the system of locks must be connected with a discrete source of compressed nitrogen or another inert gas.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. Apparatus for feeding solid particles from a receptacle into a plenum chamber, comprising a magazine for storage of charges of solid particles, said magazine being disposed at a level above said receptacle; first and second valved conduit means respectively connecting said receptacle with said magazine and with said chamber; means defining a source of compressed gas; first valved pipe means connecting said source with said receptacle; means defining a main source of supply of solid particles; pneumatic conveyor means for the transporting charges of solid particles from said main source to said magazine; and second valved pipe means connecting said receptacle with said conveyor means, said first conduit means permitting a charge of solid particles to descend into said receptacle when the valves in said first and second conduit means are respectively open and closed and the pressure of gas in said receptacle does not appreciably exceed the pressure in said magazine, said receptacle admitting solid particles into said chamber when the valve in said second conduit means is opened subsequent to admission of compressed gas into said receptacle by way of said first pipe means, and said magazine receiving a charge of solid particles when the valve in said second pipe means is open while said receptacle contains compressed gas in that the gas which escapes from said receptacle serves as a carrier of solid particles in said conveyor means.

2. Apparatus as defined in claim 1, further comprising a vessel installed in said second conduit means, the interior of said vessel being maintained at an elevated pressure which is less than the pressure in said receptacle when said first pipe means admits compressed gas thereto while said second pipe means and said first conduit means are sealed.

3. Apparatus as defined in claim 1, further comprising third conduit means connecting said conveyor means with said magazine.

4. Apparatus as defined in claim 1, further comprising means for maintaining the interior of said magazine at a pressure which equals or approximates atmospheric pressure.

5. Apparatus as defined in claim 1, wherein said gas source accomodates an inert gas.

6. Apparatus as defined in claim 1, further comprising a tank for storage of compressed gas, said tank being installed in said second pipe means, and valve means installed in said second pipe means intermediate said tank and said pneumatic conveyor means.

7. Apparatus as defined in claim 6, further comprising a second magazine, a second receptacle connected with said second magazine, a second plenum chamber connected with said second receptacle, second pneumatic conveyor means connecting said main source with said second magazine, additional valved pipe means connecting said tank with said second receptacle and with said second conveyor means, and means for admitting compressed gas to said second receptacle, said tank being arranged to selectively supply compressed gas to either or both of said conveyor means.

8. An apparatus as defined in claim 1, comprising an oxygen-containing gasification chamber arranged for connection with said receptacle.

9. A method of feeding solid particles from a receptacle into a plenum chamber, comprising the steps of introducing into the receptacle a charge of solid particles while the receptacle is disconnected from the plenum chamber; admitting into the receptacle a compressed gas to raise the pressure therein to a value exceeding the pressure in the plenum chamber; connecting the receptacle with the plenum chamber whereby the compressed gas in the receptacle undergoes partial expansion and expels at least some solid particles into the plenum chamber; disconnecting the receptacle from the plenum chamber; evacuating at least some of the compressed gas remaining in the receptacle therefrom; and utilizing at least a portion of the energy of compression of the evacuated gas for the introduction of a fresh charge of solid particles into the receptacle.

10. A method as defined in claim 9, wherein said gas is an inert gas.

11. A method as defined in claim 9, further comprising the step of storing said evacuated gas prior to its utilization for introduction of a fresh charge.

12. A method as defined in claim 9, further comprising the step of storing a fresh charge of solid particles at a level above the receptacle, and admitting the thus stored charge into the receptacle by gravity flow upon completion of said evacuating step.

13. A method as defined in claim 9, wherein the solid particles expelled from the receptacle are admitted into an oxygen-containing gasification chamber.

14. A method as defined in claim 9, wherein said solid particles comprise particles of solid fuel.

15. A method as defined in claim 9, wherein the solid particles of said fresh charge are entrained by said evacuated gas.

16. A method as defined in claim 12, wherein the solid particles of said fresh charge are injected into a flowing stream of said evacuated gas.

* * * * *